US008538315B2

(12) United States Patent
Okamoto et al.

(10) Patent No.: US 8,538,315 B2
(45) Date of Patent: Sep. 17, 2013

(54) IMAGE FORMING APPARATUS

(75) Inventors: Tetsuji Okamoto, Kanagawa (JP); Atsuyuki Kitamura, Kanagawa (JP); Masahiro Sato, Kanagawa (JP); Atsushi Ogihara, Kanagawa (JP); Satoru Torimaru, Kagoshima (JP); Junichi Murakami, Kanagawa (JP); Shuichi Nishide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 528 days.

(21) Appl. No.: 12/567,976

(22) Filed: Sep. 28, 2009

(65) Prior Publication Data

US 2010/0247197 A1 Sep. 30, 2010

(30) Foreign Application Priority Data

Mar. 24, 2009 (JP) ..... 2009-071238
Jul. 14, 2009 (JP) ..... 2009-165428

(51) Int. Cl.
*G03G 15/00* (2006.01)

(52) U.S. Cl.
USPC ..... 399/401; 399/227; 399/397; 399/388; 400/691

(58) Field of Classification Search
USPC ..... 399/401, 223, 227, 124, 125, 112, 399/397, 225, 226, 388; 271/291; 400/691, 400/692
See application file for complete search history.

(56) References Cited

U.S. PATENT DOCUMENTS

| | | | | |
|---|---|---|---|---|
| 6,484,008 | B2 | 11/2002 | Arcaro et al. | |
| 7,984,909 | B2 * | 7/2011 | Sunohara | 271/301 |
| 2002/0076242 | A1 * | 6/2002 | Arcaro et al. | 399/301 |
| 2007/0237541 | A1 * | 10/2007 | Johnson et al. | 399/107 |
| 2008/0315515 | A1 * | 12/2008 | Sunohara | 271/278 |

FOREIGN PATENT DOCUMENTS

| | | |
|---|---|---|
| JP | 63-078160 | 4/1988 |
| JP | 04-288560 | 10/1992 |
| JP | 2002-023588 | 1/2002 |
| JP | 2002-202654 | 7/2002 |
| JP | 2004-054163 | 2/2004 |
| JP | 2006-349701 | 12/2006 |

OTHER PUBLICATIONS

Office action dated Apr. 18, 2013 in JP 2009-165428 and English Translation.
English language abstract for JP 63-078160.
English language abstract for JP 2002-202654.

* cited by examiner

*Primary Examiner* — Matthew G Marini
(74) *Attorney, Agent, or Firm* — Fildes & Outland, P.C.

(57) ABSTRACT

An image forming apparatus includes: an image forming apparatus main body, an image forming unit that is provided in the image forming apparatus main body and forms an image on a recording medium, and a transport unit transporting the recording medium, wherein the image forming apparatus main body has a forward port for forwarding the recording medium having the image thereon by the image forming unit to outside of the image forming apparatus main body, and further has a guide unit by which the recording medium forwarded to the outside of the image forming apparatus main body is guided to be retrieved into the image forming apparatus main body, and to be led to the transport unit.

9 Claims, 13 Drawing Sheets

10

10

10

10a

10b

10c

10d

10e

10f

10g

10h

10i

IMAGE FORMING APPARATUS

CROSS-REFERENCE TO RELATED APPLICATIONS

This application is based on and claims priority under 35 USC 119 from Japanese Application No. 2009-071238 filed Mar. 24, 2009 and Japanese Application No. 2009-165428 filed Jul. 14, 2009.

BACKGROUND

Technical Field

This present invention relates to an image forming apparatus.

SUMMARY

According to an aspect of the present invention, there is provided an image forming apparatus comprising: an image forming apparatus main body, an image forming unit that is provided in the image forming apparatus main body and forms an image on a recording medium, and a transport unit transporting the recording medium, wherein the image forming apparatus main body has a forward port for forwarding the recording medium having the image thereon by the image forming unit to the outside of the image forming apparatus main body, and further has a guide unit by which the recording medium forwarded to the outside of the image forming apparatus main body is guided to be retrieved into the image forming apparatus main body, and to be led toward the transport unit.

BRIEF DESCRIPTION OF THE DRAWINGS

Exemplary embodiments of the present invention will be described in detail based on the following figures, wherein.

DETAILED DESCRIPTION

Next, an exemplary embodiment of the present invention will be described, based on the drawings of the first exemplary embodiment.

Figure 1:
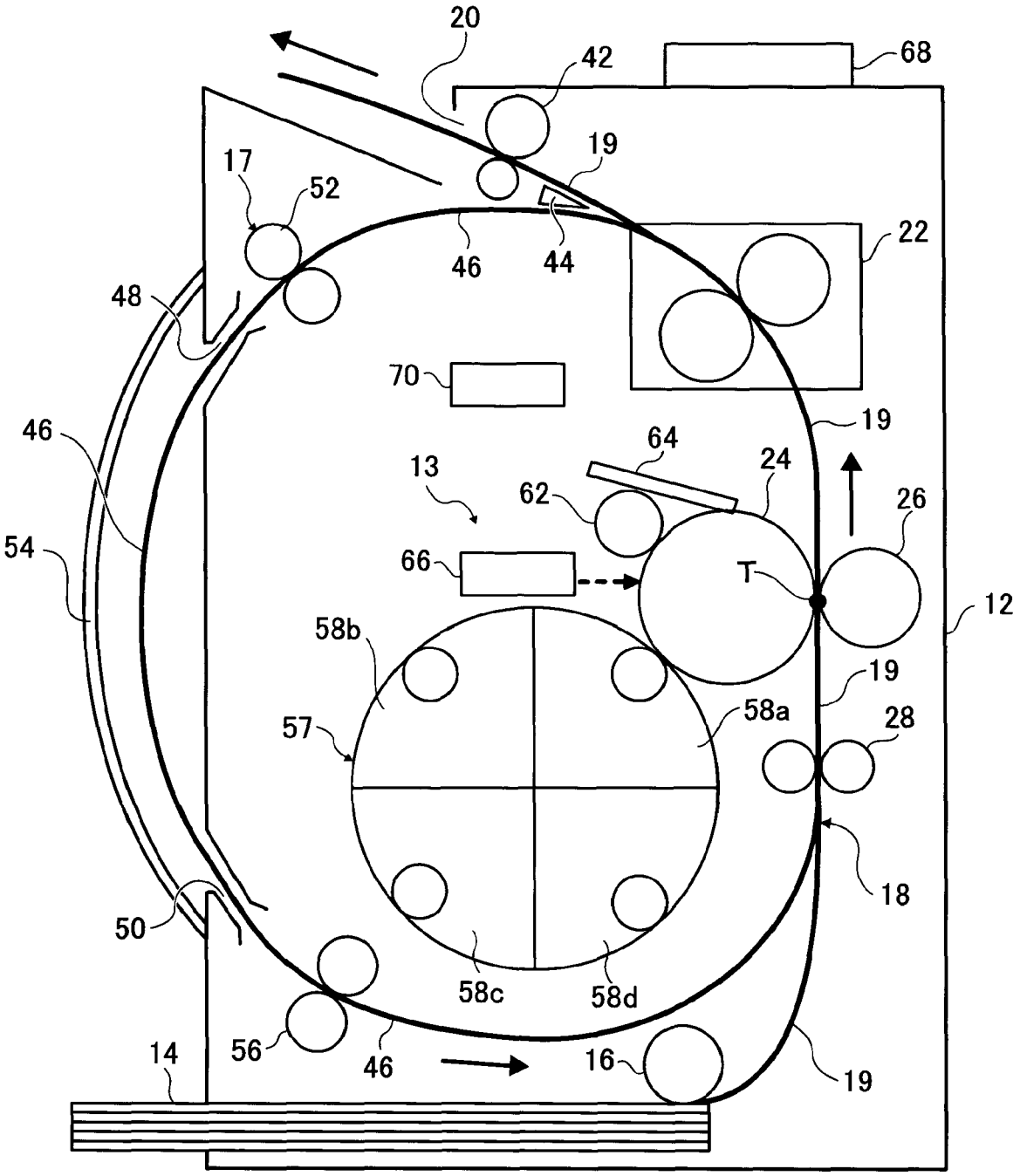
FIG. 1 is a side view showing an overview of an image forming apparatus according to a first exemplary embodiment of the invention.
Figure 2:
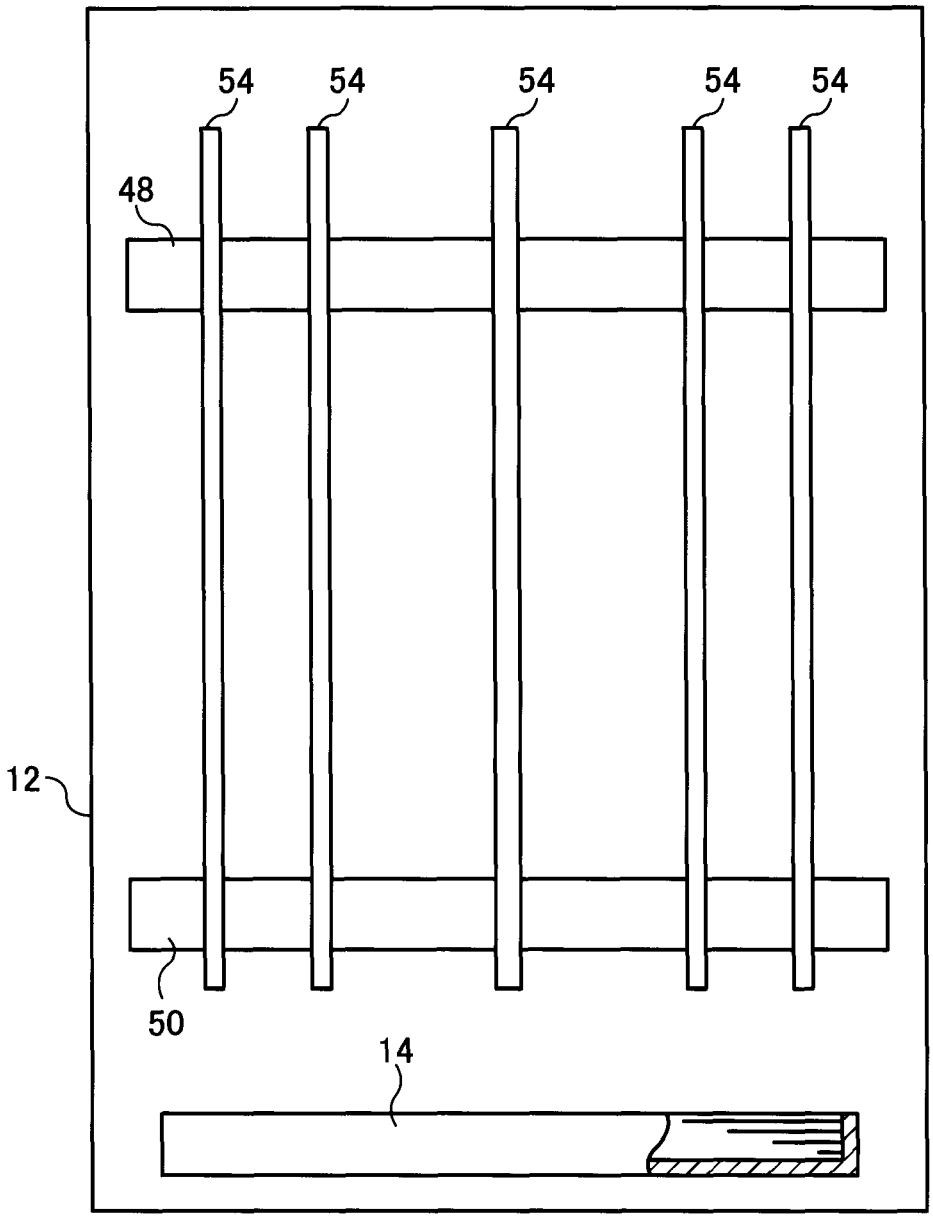
FIG. 2 is a front view showing the image forming apparatus shown in FIG. 1.
Figure 3:
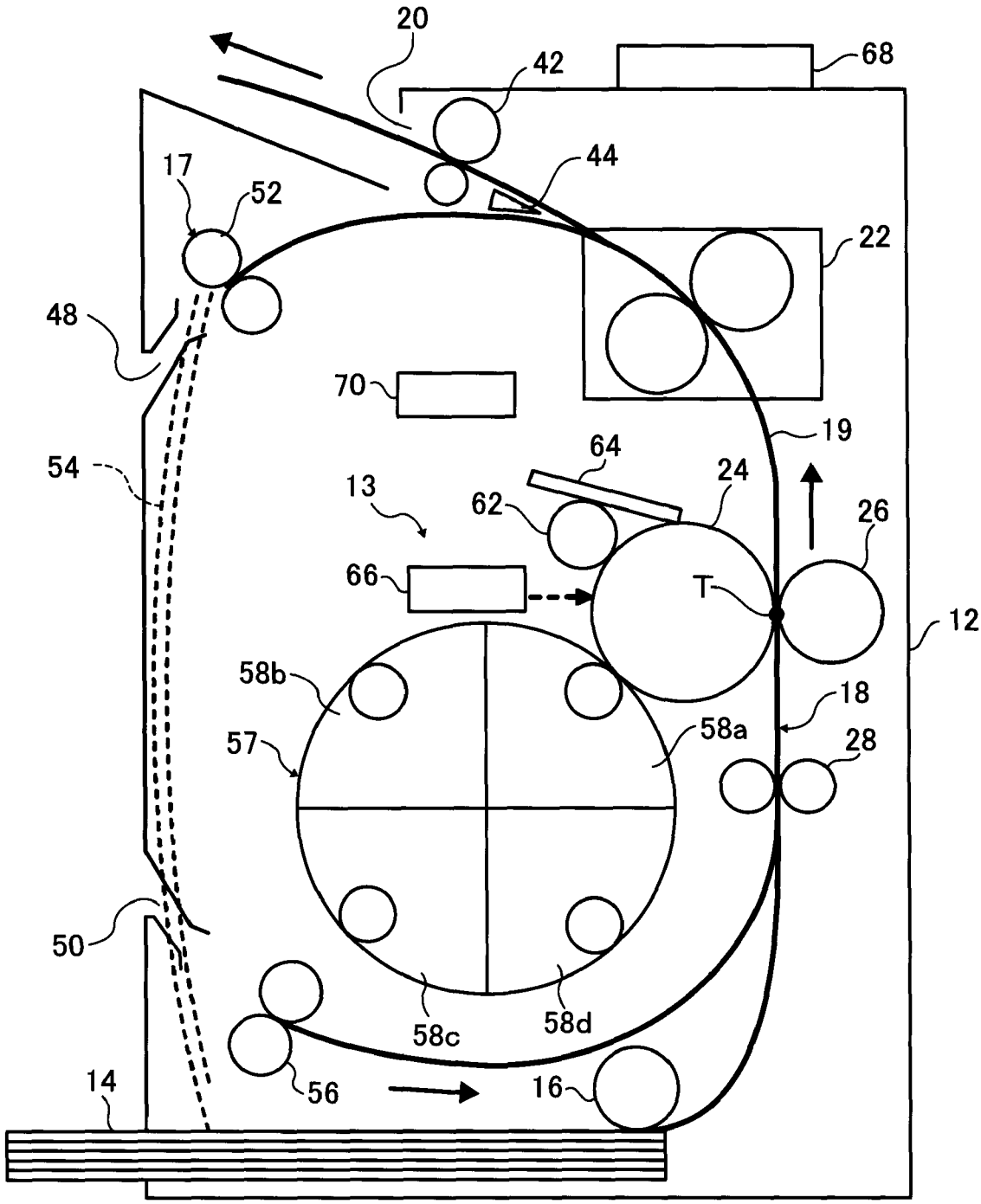
FIG. 3 is a side view showing a status where a guide member in the image forming apparatus shown in FIG. 1 is put in the image forming apparatus main body.

FIG. 1 and FIG. 3 are a side view showing an overview of an image forming apparatus 10 according to a first exemplary embodiment of the present invention, and FIG. 2 is a front view of the image forming apparatus 10.

As shown in FIG. 1 and FIG. 2, the image forming apparatus 10 has an image forming apparatus main body 12, and in the image forming apparatus main body 12, a image forming part 13 is disposed, for example, at an approximately central portion thereof, and a sheet feed unit 14 with one stage is disposed, e.g. at the bottom of the image forming apparatus main body 12. Further the image forming apparatus main body 12 has a transfer device 26 for transferring the image formed by the image forming part 13 on a recording medium, and a fixing device 22 for fixing the image transferred with the transfer device 26 to the recording medium by using, at least, heat. Note that an image forming unit, which forms an image onto a recording medium such as a plain paper, is configured with the image forming part 13 and the transfer device 26.

Further the image forming apparatus main body 12 has a transport device 17 which is used as a transport unit transporting the recording medium toward the image forming part 13 and transports the recording medium, e.g. from the sheet feed unit 14, toward the image forming part 13.

An user interface device (UI device) 68 such as a touch panel is arranged in a position above the image forming apparatus main body 12, and a controller 70 controlling each of parts configuring the image forming apparatus 10 is arranged in the image forming apparatus main body 12.

The transport device 17 has a transport path 18, transport rollers 52 and 56. The transport device 17 is also used as a transport unit which transports the recording medium from the fixing device 22 to the transfer device 26 for further transferring an image to the recording medium fixed the image onto with the fixing device 22.

The transport path 18 has a main transport path 19 and a repeat path 46. Along the transport path 18, the recording medium is capable of becoming transported so as to be forwarded from the forward port 48 to the outside of the image forming apparatus main body 12 with passing around at least a portion of the image forming unit 13, and be retrieved into the image forming apparatus main body 12.

An exit 20 for ejecting the recording medium toward e.g. the upper side and e.g. a front side of the image forming apparatus main body 12 (the left side on FIG. 1) is formed in the image forming apparatus main body 12. Further the forward port 48 is shaped on e.g. the front side of the image forming apparatus main body 12. The forward port 48 is used as a position where the recording medium having the image thereon by the image forming part 13 is forwarded to the outside of the image forming apparatus main body 12. Further a retrieve port 50 is shaped, e.g., at the front side of the image forming apparatus main body 12, and, e.g., in a lower part of the forward port 48. The retrieve port 50 is used as a position where the recording medium, which is forwarded to the outside of the image forming apparatus main body 12 to pass through the forward port 48, is retrieved into the image forming apparatus main body 12.

A guide member 54 is arranged on the front side of the image forming apparatus main body 12 so as to be placed e.g. on the exterior surface of the image forming apparatus main body 12.

The image forming part 13 has an image carrier 24 such as e.g. a photoreceptor, a charging device 62, an optical projection device 66, a rotary development device 57, and an image carrier cleaner 64.

The charging device 62, consisting e.g. a charging roller, is arranged in the front side of the image carrier 24, and evenly charges the image carrier 24. The optical projection device 66 is arranged above the rotary development device 57, and projects an electrostatic latent image on the image carrier 24 charged with the charging device 62 with a beam such as a laser beam. The rotary development device 57 is arranged e.g. in a lower part of an approximately central portion, and has four development units 58*a* to 58*d*, respectively containing four colors of developers, i.e., yellow, magenta, cyan, and black developers, to sequentially visualize an electrostatic latent image carried on the image carrier 24 with each color developer. The image carrier cleaner 64 abuts on the image carrier 24 upstream relative to the charging device 62 in the direction of rotation of the image carrier 24, and scrapes off developer particles remaining on the image carrier 24 after transfer.

The transfer device 26, consisting of e.g. a transfer roller having elastic surface, is arranged in the rear side of the image carrier 24, and sequentially transfers the developer images visualized with the development unit 58*a* to 58*d* to the recording medium in a transfer position T as shown FIG. 1.

The fixing device 22, having a heat roller and a pressure roller, is arranged downstream of the transfer position T in the transport direction of the recording medium, and fixes the developer images, which is obtained from the image carrier 24 and transferred to the recording medium with transfer device 26, on the recording medium by using heat and pressure.

A pickup roller 16 for picking up the recording medium from the sheet feed unit 14 is arranged in a position above the sheet feed unit 14. The pickup roller 16, driven by a driver (not shown), rotates to supply the recording medium toward a transport path 18.

The main transport path 19 is a recording medium passage from the pickup roller 16 to the exit 20. The main transport path 19 is in the rear side of the image forming apparatus main body 12 (the right side portion in FIG. 1), and has an approximate vertical part from the sheet feed unit 14 to the exit 20. Along the main transport path 19, in upstream side of a fixing device 22, the above image carrier 24 and the above transfer device 26 are arranged. Further, a registration roller 28 is arranged in the upstream side of the image carrier 24 and the transfer roller 26. Further, an exit roller 42 is arranged in the vicinity of the exit 20 in the transport path 18.

Downstream of the fixing device 22 in the transfer direction of the recording medium, a switching device 44 is disposed. The switching device 44 switches the recording medium transported from a side of the fixing device 22 to the exit roller 42 or to a side of the repeat path 46 for transporting.

The repeat path 46 is a passage where the recording medium is transported to be returned from a position where the switching device 44 is disposed to the registration roller 28. A part of the repeat path 46 is in an outside of the image forming apparatus main body 12. That is, along the repeat path 46, the recording medium is forwarded to the outside of the image forming apparatus main body 12, and subsequently is retrieved into the image forming apparatus main body 12. In particular, the recording medium is guided with the switching device 44 to the repeat path 46 to be forwarded with a transport roller 52 from the forward port 48 to the outside of the image forming apparatus main body 12, and further, the recording medium is guided by a guide member 54 to be retrieved into the image forming apparatus main body 12 at the retrieve port 50. Furthermore, the recording medium is transported with the transport roller 56 to the registration roller 28. Note that the recording medium is subjected to a pressure by gravity, thereby goes down while passing through the repeat path 46 in the outside of the image forming apparatus main body 12.

Note that, the guide member 54 consisting of plural wires such as a steel wire may be stored inside the image forming apparatus main body 12 as shown in FIG. 2 when color printing is not performed.

Figure 4:
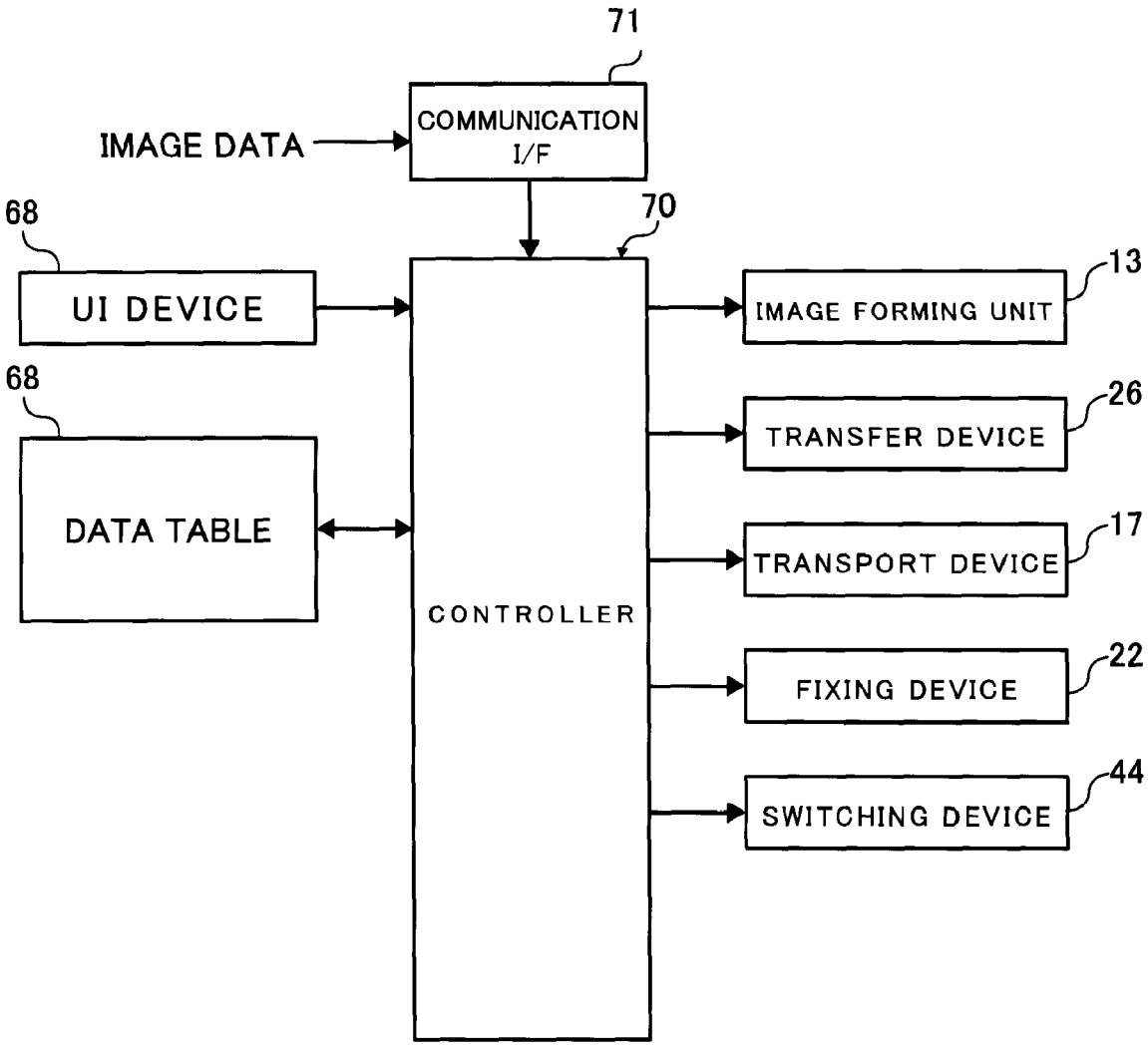
FIG. 4 is a block diagram showing a controller of the image forming apparatus shown in FIG. 1.

FIG. 4 is a block diagram showing the controller 70.

The controller 70 has a control circuit consisting of e.g. CPU, and as shown in FIG. 4, receives image data via a communication interface 71. Further, the controller 70 receives input data information from a user interface (UI) device 68. The data information from the UI device 68 includes, e.g. types and thickness of a recording medium which is stored in the sheet feed unit 14 and is formed an image onto.

The controller 70 is connected with a data table 69. The data table 69 stores information for a relation between type, thickness, size or the like, which the recording medium has, and a appropriate heating temperature for heating the recording medium with the fixing device 22 according to the above conditions. The data table 69 further stores a relation between at least one condition of the recording medium type, the recording medium thickness, and heating temperature for heating the recording medium with the fixing device 22, and an appropriate time where the recording medium, forwarded to the outside of the image forming apparatus main body 12, has been retrieved into the image forming apparatus main body 12.

The controller 70 connects to the image forming part 13, the transfer device 26, the transport device 17, the fixing device 22, the switching device 44 and the like to control by transmitting data. In particular, the controller 70 controls the image forming part 13, the transfer device 26, the transport device 17, the fixing device 22, the switching device 44 and the like so as to forward the recording medium having the image thereon from the forward port 48 to the outside of the image forming apparatus main body 12, whenever e. the image forming part 13 and the transfer device 26 forms a single-color image onto the recording medium.

Further, the controller 70 controls the image forming part 13, the transfer device 26, the transport device 17, the fixing device 22, the switching device 44 and the like so as to forward the recording medium having a image formed to the outside of the image forming apparatus main body 12 whenever a single-color image transferred onto the recording medium with the transfer device 26 is fixed on the recording medium with the fixing device 22. Further, the controller 70 controls the image forming part 13, the transfer device 26, the transport device 17, the fixing device 22, the switching device 44 and the like so as to optimize time until the recoding medium forwarded to the outside of the image forming apparatus main body 12 has retrieved into the image forming apparatus main body 12 according to at least one condition of the recording medium type, the recording medium thickness, and heating temperature for heating the recording medium with the fixing device 22, with reference to a data table.

In the image forming apparatus 10 configured as the above-described, when a single-color such as a black image is formed, under the control of the controller 70, the recording medium is picked up from the sheet feed unit 14 with the pickup roller 16 and is transported toward the registration roller 28. Further, when a front edge of the recording medium transported is temporarily stopped with the registration roller 28, the recording medium is transported between the image carrier 24 and the transfer device 26 at predetermined timing, and is subjected to transfer of e.g. a black developer image on the surface of the recording medium. Further, the black developer image transferred onto the recording medium is fixed on the recording medium with the fixing device 22, and the recording medium fixed the developer image onto is ejected with an exit roller 42 from the exit 20.

Whereas, in the case of color printing used yellow, magenta, cyan, and black developers, the recording medium is returned to the repeat path 46, e.g. three times under the control of the controller 70, and the yellow, magenta, cyan, and black developers image formed onto the image carrier 24 is transferred to the recording medium with each developer superposed.

In the case of color printing, the controller 70 controls the switching device 44 to switch a transport passage to the repeat path 46 side. Then, the recording medium is forwarded with the transport roller 52 from the forward port 48 to the outside of the image forming apparatus main body 12, and further, is guided along a guide member 54 on outside of the image forming apparatus main body 12 to be retrieved into the image forming apparatus main body 12 at the retrieve port 50. Further the recording medium is transported with the transport roller 56 to the registration roller 28. Then, the recording medium passes through the registration roller 28, a portion between the image carrier 24 and the transfer device 26, and the fixing device 22 four times. The recording medium having transferred four color developer images is ejected from the exit 20 with the switching device 44 controlled for switching.

When an image forming signal is sent to the controller 70, in the image forming part 13, the image carrier 24 is evenly charged with the charging device 62, and a light ray corresponding to a yellow image is emitted from the optical projection device 66 to the image carrier 24 charged based on the image signal. The light ray from the optical projection device 66 exposes the surface of the image carrier 24, thereby an electrostatic latent image is formed.

The electrostatic latent image carried on the image carrier 24 is developed with the yellow developer supplied from the development unit 58*a*, and is transferred to the recording medium supplied from the sheet feed unit 14. The recording medium to which the yellow developer image has been transferred is led to the fixing device 22, and the developer image is fixed on the recording medium with the heating roller and the pressure roller.

Note that the recording medium fixed the yellow developer image onto is, as mentioned above, guided to the repeat path 46 with the switching device 44, and is forwarded from the forward port 48 toward the outside of the image forming apparatus main body 12, and subsequently is retrieved into the image forming apparatus main body 12 at the retrieved port 50 with guided by the guide member 54.

Developer particles remaining on the image carrier 24 is scraped off with the image carrier cleaner.

Then the image carrier 24 is evenly charged again with the charging device 62, and a light ray corresponding to a magenta image is emitted from the optical projection device 66 to the image carrier 24 charged based on the image signal. The light ray from the optical projection device 66 exposes the surface of the image carrier 24, thereby an electrostatic latent image is formed.

The electrostatic latent image carried on the image carrier 24 is developed with the magenta developer supplied from the development unit 58*b*, and is overlay-transferred to the recording medium having passed through the repeat path 46.

The recording medium to which the magenta developer image has been transferred is led to the fixing device 22 to be fixed the developer image thereon with the heating roller and the pressure roller. The recording medium on which the magenta developer image is fixed is, as mentioned above, guided to the repeat path 46 with the switching device 44. Developer particles remaining on the image carrier 24 is scraped off with the image carrier cleaner 64.

The recording medium is returned toward the registration roller 28 three times, and as in the case of the yellow and magenta developer images, developer images developed with the cyan and the black developers are fixed on the recording medium by the fixing device 22. Thus a color image is formed with overlaid developer images on the recording medium. The recording medium to which the color image has been fixed is led to the exit roller 42 with the switching device 44 and is ejected.

In the image forming apparatus 10, when the recording medium is transported from the fixing device 22 to the transfer device 26 so that a image may be further transferred on the recording medium on which the image has been fixed with the fixing device 22, as mentioned above, the transport device 17 forwards the recording medium, on which the image has been fixed with the fixing device 22, toward the outside of the image forming apparatus main body 12, and retrieves again the recording medium forwarded into the image forming apparatus main body 12. Accordingly, the image forming apparatus 10 reduces a problem that the image quality may be reduced when an image is further formed on the recording medium, on which the image has been fixed by heating.

In general, when the recording medium is subjected to heating for fixing an image thereon, moisture is evaporated and changes shape. Accordingly, the image may not be formed successfully when overlay-transfer of images on the recording medium fixed the image onto is performed in the status where the recording medium changes shape. Whereas, the image forming apparatus 10 allows the recording medium not to change shape by forwarding the recording medium to the outside of the image forming apparatus main body 12 to expose the recording medium, subjected to heating for fixing, to the air, thereby the recording medium absorbs water in the air. After the deformation of the recording medium has disappeared, the recording medium is transferred next image onto. Accordingly, reduction of image quality due directly to the deformation of the recording medium is hardly caused.

Furthermore, in general, when the recording medium is subjected to heating for fixing an image, since moisture in the recording medium is evaporated and resistance value of the recording medium changes because of reduction of the moisture content in the recording medium, i.e. the sheet moisture content thereof. Accordingly, the image may not be formed successfully when overlay-transfer of images on the recording medium fixed the image onto is performed. Whereas, the image forming apparatus 10 allows the recording medium to have a stable moisture content by forwarding the recording medium to the outside of the image forming apparatus main body 12 to expose the recording medium, subjected to heating for fixing, to the air, thereby the recording medium absorbs water in the air. After the moisture content of the recording medium has been stable, the recording medium is transferred next image onto. Accordingly, reduction of image quality due directly to the change of the resistance value in the recording medium is hardly caused.

Next, a first modified version according to the first exemplary embodiment of the present invention will be described.

Figure 5:
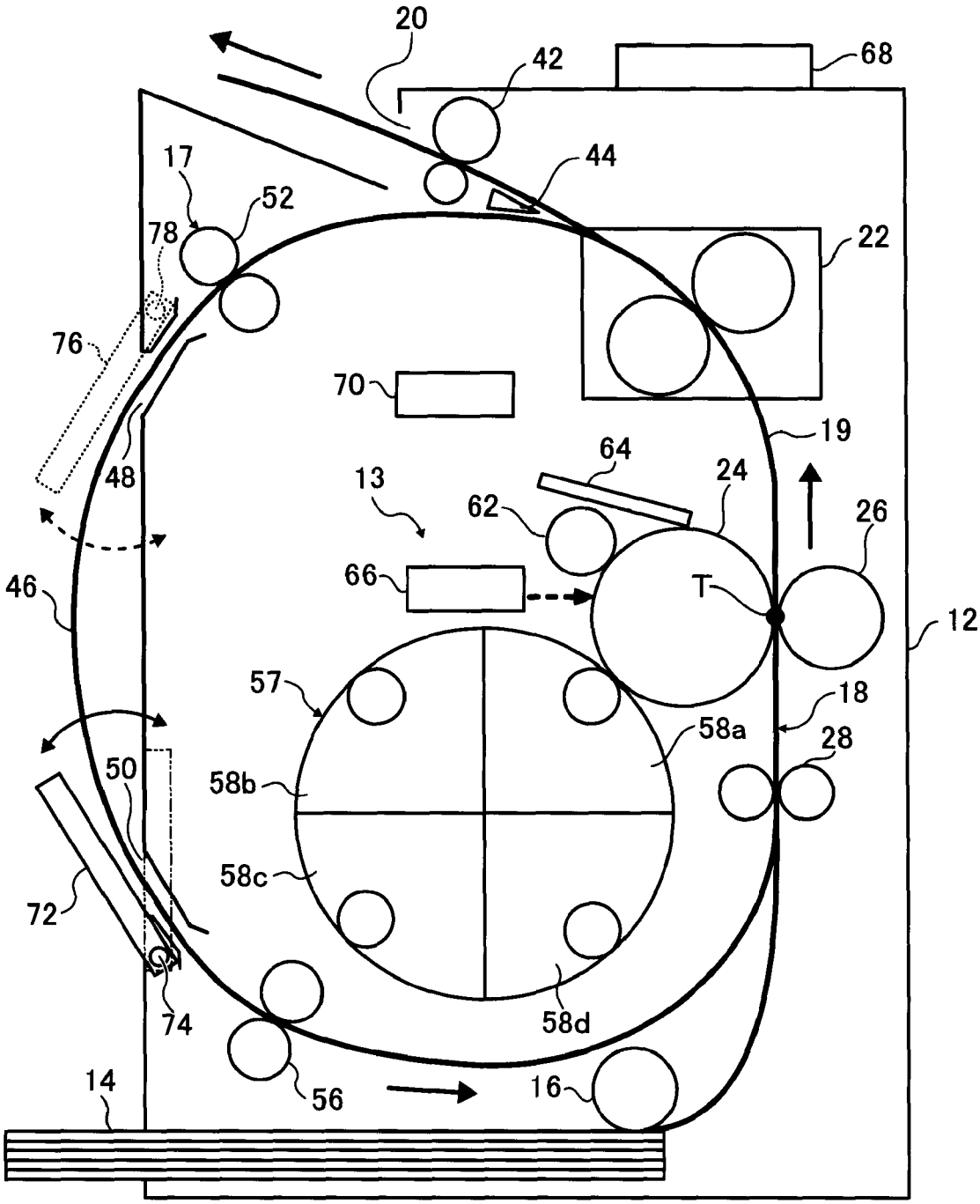
FIG. 5 is a side view showing an overview of a first modified version of an image forming apparatus according to the first exemplary embodiment, an image forming apparatus 10*a;*

FIG. 5 is a side view showing an overview of a first modified version of the image forming apparatus 10 according to the first exemplary embodiment, the image forming apparatus 10*a*. Note that the image forming apparatus 10*a* shown in FIG. 5 indicates the parts substantially similar to the parts configuring the image forming apparatus 10 shown in FIG. 1 to FIG. 3 with the same reference numeral as the image forming apparatus 10.

As shown in FIG. 5, a retrieve guide member 72 is provided on the retrieve port 50 side in the image forming apparatus main body 12 so that the recording medium on the repeat path 46 may be retrieved into the image forming apparatus main body 12 at the retrieve port 50.

The retrieve guide member 72 is used as a retrieve guide part, consisting of e.g. a platy member. When a color printing is not performed in the image forming apparatus 10*a*, the retrieve guide member 72 is capable of being stored inside the image forming apparatus main body 12 by swung around a fulcrum 74 as a center.

When color printing is performed in the image forming apparatus 10*a*, the controller 70 controls the switching device 44 to switch toward the repeat path 46. Then, the recording medium is forwarded with the transport roller 52 from the forward port 48 to the outside of the image forming apparatus main body 12, and further, is guided along the retrieve guide member 72, placed outside the image forming apparatus main body 12, to be retrieved into the image forming apparatus main body 12 at the retrieve port 50. Further the recording medium is transported with the transport roller 56 to the registration roller 28. Thus the recording medium is passed through the registration roller 28, a portion between the image carrier 24 and the transfer device 26, and the fixing device 22 four times and is ejected from the exit 20. Note that the recording medium is subjected to a pressure by gravity to go down while passing through the repeat path 46 in the outside of the image forming apparatus main body 12

The image forming apparatus 10*a* may have a guide member 76 which is arranged in the forward port 48 side of the image forming apparatus main body 12 and guides the recoding medium toward the retrieve port 50. The guide member 76, consisting of e.g. a platy member, is capable of being stored inside the image forming apparatus main body 12 by swung around a fulcrum 78 as a center when a color printing is not performed in the image forming apparatus 10*a*.

Next, a second modified version according to the first exemplary embodiment of the present invention will be described.

Figure 6:
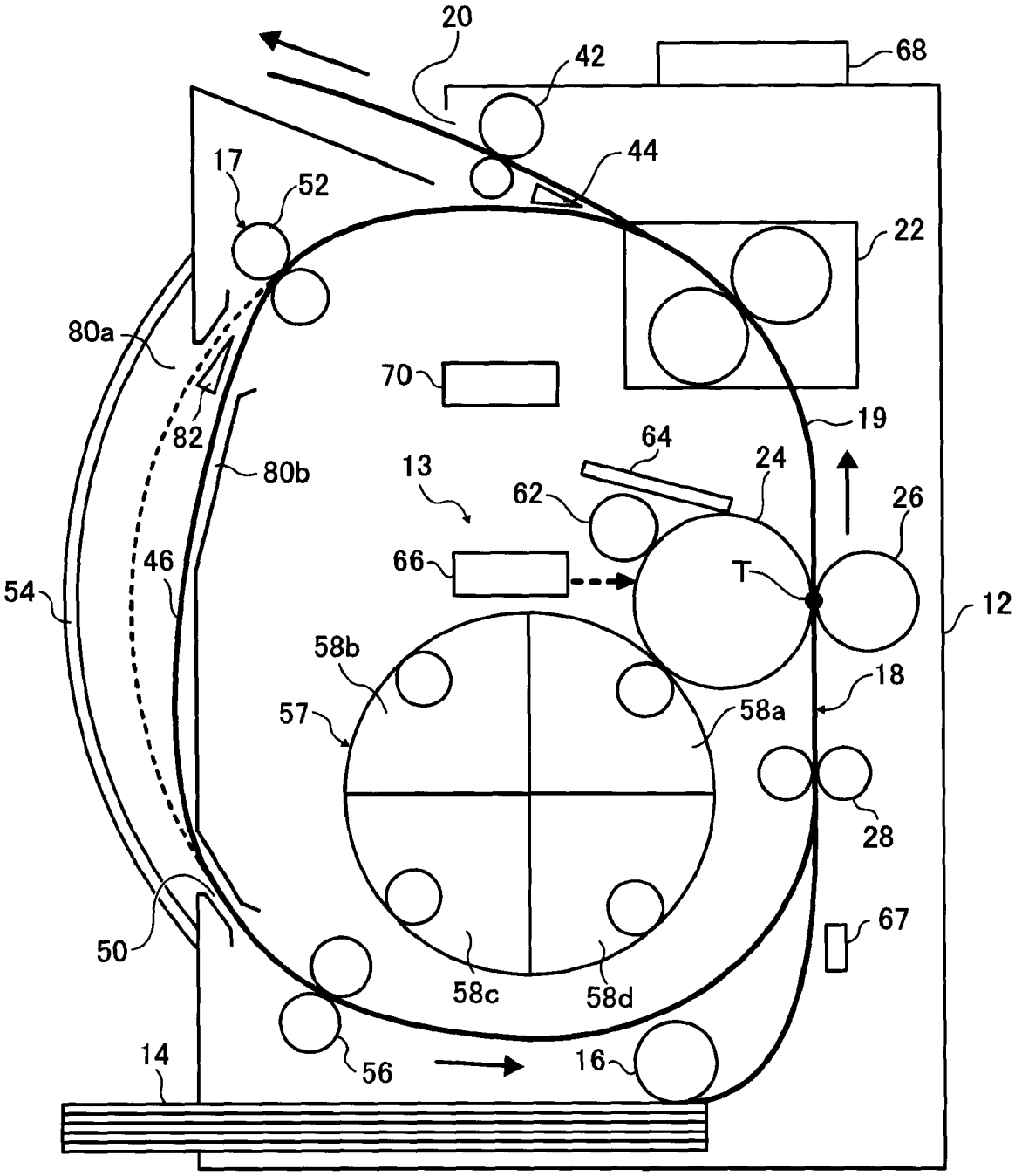
FIG. 6 is a side view showing an overview of a second modified version of the image forming apparatus according to the first exemplary embodiment, an image forming apparatus 10*b;*

FIG. 6 is a side view showing an overview of a second modified version of the image forming apparatus 10 according to the first exemplary embodiment, the image forming apparatus 10*b*. Note that the image forming apparatus 10*b* shown in FIG. 6 indicates the parts substantially similar to the parts configuring the image forming apparatus 10 shown in FIG. 1 with the same reference numerals as the parts of the image forming apparatus 10.

While the image forming apparatus main body 12 has one forward port, i.e. the forward port 48 in the above-described image forming apparatus 10 according to the first exemplary embodiment, in the image forming apparatus 10*b* as the second modified version, the image forming apparatus main body 12 has two forward ports 80*a* and 80*b* arranged in the upper front side of the image forming apparatus main body 12 from the top as shown in FIG. 6. Further, the image forming apparatus 10*b* has a switching device 82 for switching the transported recording medium from the forward port 80*a* to the outside of the image forming apparatus main body 12 or from the forward port 80*b* toward outside the image forming apparatus main body 12. The switching device 82 is controlled by the controller 70 as the switching device 44 and the like.

When the recording medium is guided to the repeat path 46 with the switching device 44 in the image forming apparatus 10*b*, the recording medium is forwarded to the outside of the image forming apparatus main body 12 from the forward port 80*a* or 80*b* by switched the switching device 82. Note that the controller 70 controls the switching device 82 for switching based on the recording medium length in the transport direction input via e.g. UI device 68. For instance, when the recording medium length in the transport direction is equal or more than the predetermined length, the controller 70 controls the switching device 82 for switching to forward the recording medium from the forward port 80*a* to the outside of the image forming apparatus main body 12. When the recording medium length in the transport direction is less than the predetermined length, in order to shorten the length of the repeat path 46, the controller 70 controls the switching device 82 for switching to forward the recording medium from the forward port 80*b* to the outside of the image forming apparatus main body 12.

The image forming apparatus 10*b* may have a detection device 67 detecting the recording medium length in the transport direction in the image forming apparatus main body 12, accordingly, the controller 70 may be input data of the recording medium length in the transport direction detected with the detection device 67, and controls the switching device 82 for switching based on the recording medium length in the transport direction input.

Next, a third modified version according to the first exemplary embodiment of the present invention will be described.

Figure 7:
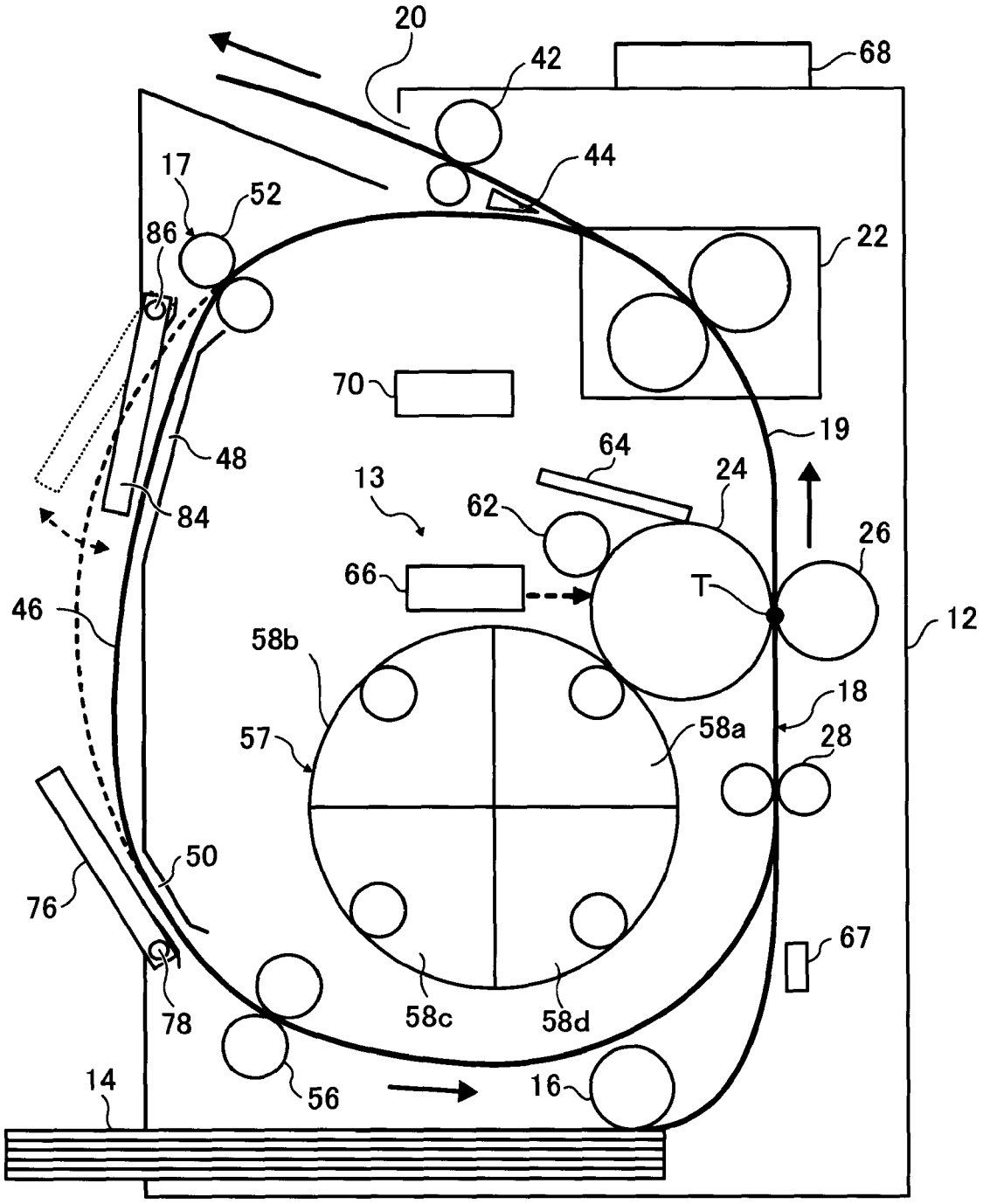
FIG. 7 is a side view showing an overview of a third modified version of the image forming apparatus according to the first exemplary embodiment, an image forming apparatus 10*c;*

FIG. 7 is a side view showing an overview of the third modified version of the image forming apparatus 10 according to the first exemplary embodiment, the image forming apparatus 10*c*. Note that the image forming apparatus 10*c* shown in FIG. 7 indicates the parts substantially similar to the parts configuring the image forming apparatus 10*a* shown in FIG. 5 with the same reference numerals as the parts of the image forming apparatus 10.

As shown in FIG. 7, the image forming apparatus 10*c* has a forward guide member 84 to guide the recording medium forwarded from the forward port 48 toward the predetermined direction switchable. When the recording medium is guided with the switching device 44 to the repeat path 46, forward angle of the forward guide member 84 is switched by the controller 70, accordingly, the recording medium is forwarded toward the outside of the image forming apparatus main body 12 with the forward angle switched. Note that the controller 70 controls the forward angle of the forward guide member 84 to switch based on data of the recording medium length in the transport direction input via e.g. UI device 68. For instance, when the recording medium length in the transport direction is equal or more than the predetermined length, in order to lengthen the length of the repeat path 46, the controller 70 controls the forward guide member 84 for switching to forward the recording medium to the direction away from the image forming apparatus main body 12. When the recording medium length in the transport direction is shorter than the predetermined length, in order to shorten the length of the repeat path 46, the controller 70 controls the forward guide member 84 for switching to forward the recording medium to the direction not far from the image forming apparatus main body 12.

Note that the forward guide member 84, consisting of e.g. a platy member, in the case where a color printing is performed in the image forming apparatus 10*c*, is capable of being stored inside the image forming apparatus main body 12 by swung around a fulcrum 86 as a center.

Next, a fourth modified version according to the first exemplary embodiment of the present invention will be described.

Figure 8:
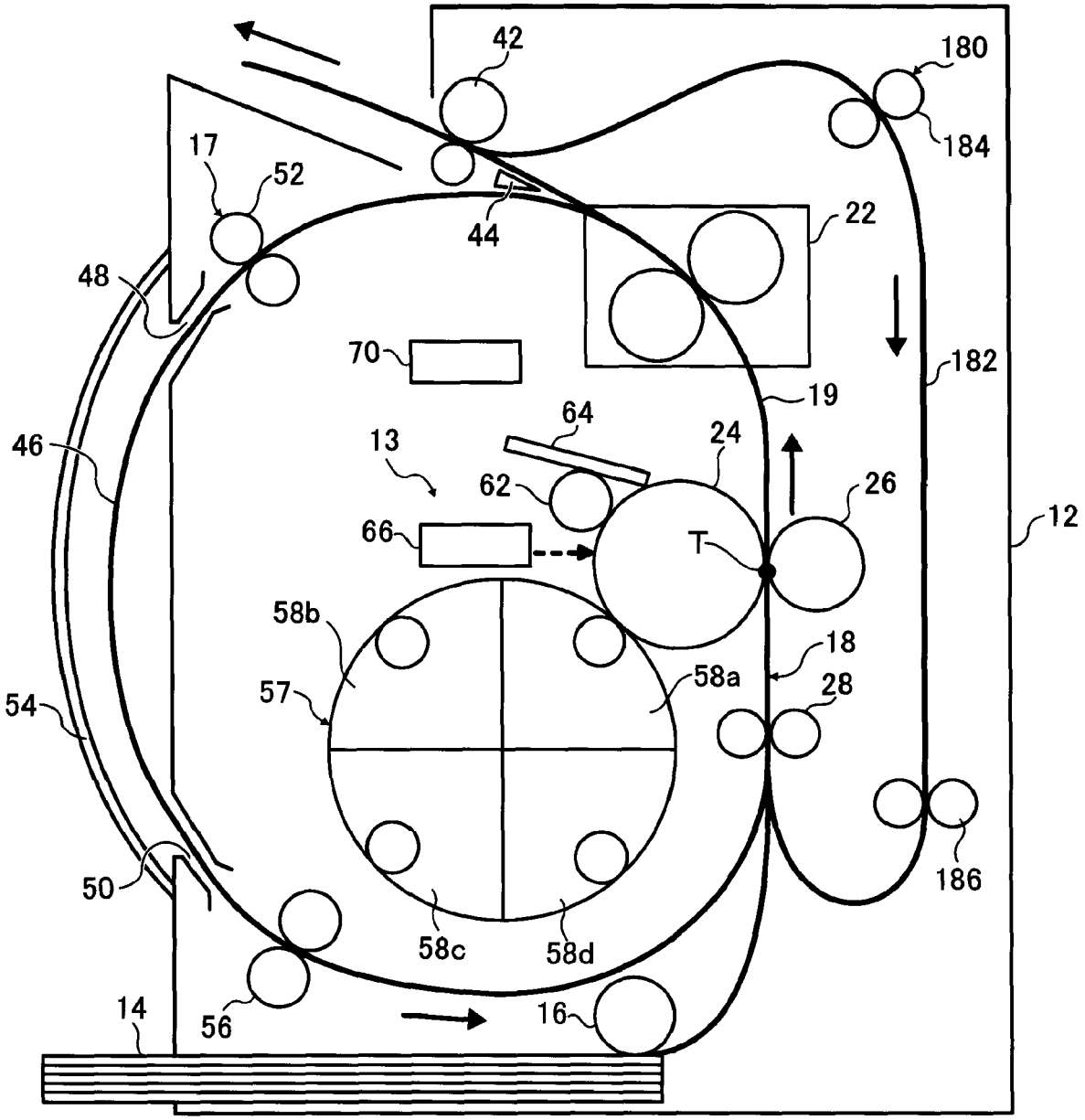
FIG. 8 is a side view showing an overview of a fourth modified version of the image forming apparatus according to the first exemplary embodiment, an image forming apparatus 10*d;*

FIG. 8 is a side view showing an overview of the fourth modified version of the image forming apparatus 10 according to the first exemplary embodiment (the image forming apparatus 10*d*). Note that in the image forming apparatus 10*d* shown in FIG. 8 indicates the parts substantially similar to the parts configuring the image forming apparatus 10 shown in FIG. 1 with the same reference numeral as the image forming apparatus 10.

Further to the configuration which the image forming apparatus 10 according to the first exemplary embodiment has, the image forming apparatus 10*d* has a reversing guide member device 180 used as a reversing guide unit which guides the recording medium, on which the image has been formed, for leading to the transport device 17 with reversing the recording medium. The reversing guide device 180 has a reversing transport path 182, connecting the exit roller 42 and the position at upstream side of the registration roller 28 in the transporting direction, and two reversing transport rollers 184 and 186 transporting the recording medium in the direction of an arrow shown in FIG. 8. The image forming apparatus 10*d* controls the exit roller 42 to rotate in the direction opposite to the rotation direction in ejecting the recording medium.

In the case that the recording medium formed the image on one surface thereof is further formed the image on another surface thereof, the controller 70 of the image forming apparatus 10*d* controls the exit roller 42 to start rotating in the opposite direction at the time where the trail edge of the recording medium formed the image on the one surface is sandwiched with the exit roller 42. The exit roller 42 reverses, and then, the recording medium, formed the image on the one surface is passed through a reversing transport path 182 and is transported to the transport path 18 at the position upstream of the registration roller 182 with reversing.

The mentioned-above fourth modified version according to the first exemplary embodiment may be combined with the first modified version, the second modified version, or the third modified version. That is, the reversing guide device 180 may be mounted in the image forming apparatus 10*a* of the first modified version, the image forming apparatus 10*b* of the second modified version, or the image forming apparatus 10*c* of the third modified version.

Next, a fifth modified version according to the first exemplary embodiment of the present invention will be described.

Figure 9:
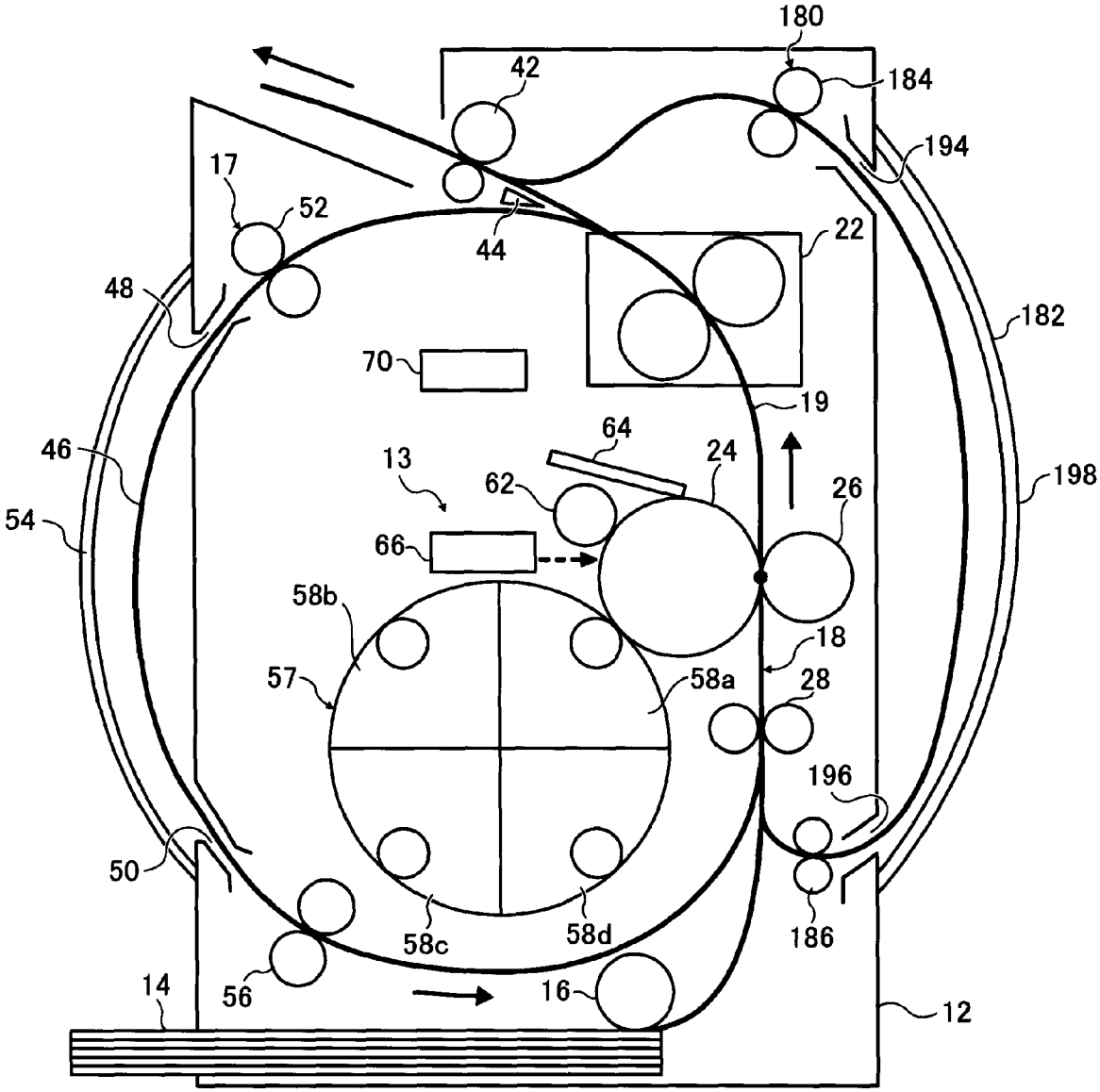
FIG. 9 is a side view showing an overview of a fifth modified version of the image forming apparatus according to the first exemplary embodiment, an image forming apparatus 10*e;*

FIG. 9 is a side view showing an overview of the fifth modified version of the image forming apparatus 10 according to the first exemplary embodiment, the image forming apparatus 10*e*. Note that the image forming apparatus 10*e* shown in FIG. 9 indicates the parts substantially similar to the parts configuring the image forming apparatus 10*d* shown in FIG. 8 with the same reference numeral as the image forming apparatus 10.

In the mentioned-above image forming apparatus 10*d* (Refer to FIG. 8), the reversing transport path 182 is formed inside the image forming apparatus main body 12. Whereas, in the image forming apparatus 10*e* as the fifth modified version, at least a portion of the reversing transport path 182 is formed on outside of the image forming apparatus main body 12. In particular, a forward port 194 and a retrieve port 196 are formed in the image forming apparatus main body 12, and the reversing transport path 182, along which the recording medium is forwarded to the outside of image forming apparatus main body 12 with the reversing transport roller 184 and is retrieved again at the retrieve port 196 into the image forming apparatus main body 12, is formed.

Further, the image forming apparatus 10*e* has a guide member 198 to guide the recording medium from the forward port 194 to the retrieve port 196. The guide member 198 consists of e.g. steel materials such as plural wires, and is attached on the exterior surface of the image forming apparatus main body 12.

The mentioned-above fifth modified version of the image forming apparatus 10 according to the first exemplary embodiment may be combined with the first modified version, the second modified version, or the third modified version. That is, the reversing guide device 180, which forwards the recording medium to the reversing transport path 182 having at least a portion formed in outside of the image forming apparatus main body 12, may be mounted in the image forming apparatus 10*a* of the first modified version, the image forming apparatus 10*b* of the second modified version, or the image forming apparatus 10*c* of the third modified version.

Next, a second exemplary embodiment of the present invention will be described.

Figure 10:
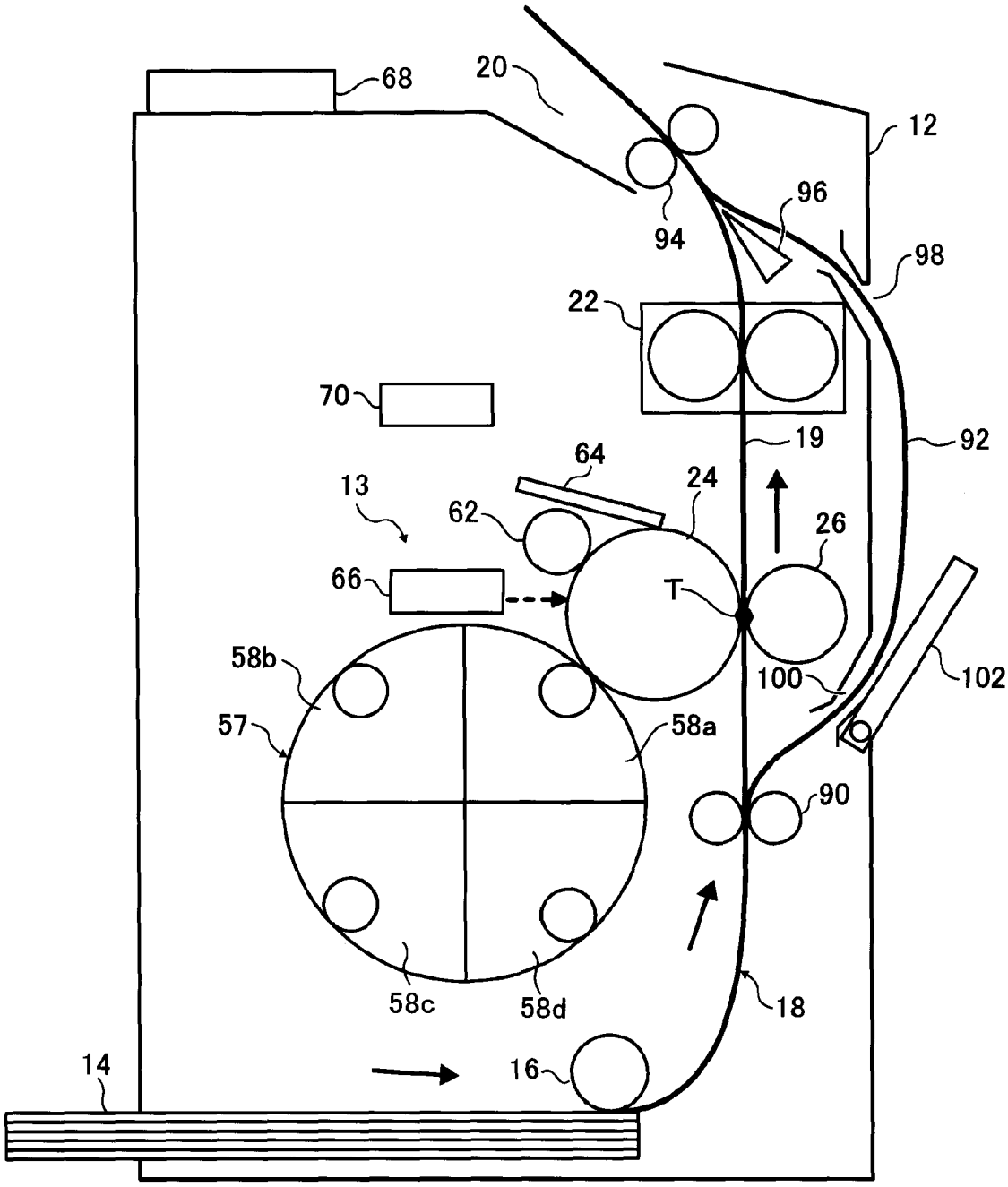
FIG. 10 is a side view showing an overview of an image forming apparatus 10*f* according to a second exemplary embodiment of the invention.

FIG. 10 is a side view showing an overview of the image forming apparatus 10*f* according to the second exemplary embodiment of the present invention. Note that the image forming apparatus 10*f* shown in FIG. 10 indicates the parts substantially similar to the parts configuring the image forming apparatus 10 shown in FIG. 1 with the same reference numeral as the image forming apparatus 10.

In the image forming apparatus 10*f*, control by the controller 70 allows the registration roller 90 to be reversible, and to transport the recording medium toward the transfer position T at the predetermined timing. The mentioned-above image forming apparatus 10 according to the first exemplary embodiment has the transport path 18 having the main transport path 19 and the repeat path 46. Whereas, the image forming apparatus 10*d* has a transport path 18 having the main transport path 19 and a repeat path 92.

Further, the controller 70 of the image forming apparatus 10*f* controls an exit roller 94 to be capable of reversing. Furthermore, the image forming apparatus 10*f* has a switching device 96 between the fixing device 22 and the exit roller 94 in the transport direction. The switching device 96 is controlled by the controller 70.

In the image forming apparatus 10*f*, when a color printing is performed, as mentioned above, the recording medium is returned to the repeat path 92. That is, a position of the transport path 18 in the front of the reversible exit roller 94 is forked, and a switching device 96 is disposed on the fork point. Further, the repeat path 92 returning the recording medium from the forked position to downstream the registration roller 90 is formed.

The repeat path 92, which a part of the repeat path 92 is formed on outside of the image forming apparatus main body 12, allows the recording medium to be retrieved again into the image forming apparatus main body 12 following forwarding the recording medium to outside of the image forming apparatus main body 12. That is, in the rear side of the image forming apparatus main body 12 (Right side in FIG. 6), a forward port 98 and a retrieve port 100 are formed in the upper part and the lower part of the image forming apparatus main body 12, respectively. The exit roller 94 reverses at the time where the retail edge short of the recording medium reaches the exit roller 94, accordingly, the recording medium is guided to the repeat path 92 with the switching device 96. Further, the recording medium is forwarded from the forward port 98 to outside of the image forming apparatus main body 12. Further, by guided with the guide member 102 in outside of the image forming apparatus main body 12, the recording medium is retrieved at the retrieve port 100 into the image forming apparatus main body 12, and is transported from downstream side of the transport path 18 to the registration roller 90.

The registration roller 90 reverses to transport the recording medium to the upstream side of the transport path 18, that is, backward feeds the recording medium, thereby the recording medium is returned to the sheet feed unit 14 side and is transported toward the transfer position T at the predetermined timing.

Thus, in the case of color printing, the switching device 96 is switched a transport path to the repeat path 92 side. Then, the recording medium is forwarded by reversing of the exit roller 94 from the forward port 98 to the outside of the image forming apparatus main body 12, and further, is guided along a guide member 102, placed on outside of the image forming apparatus main body 12, to be loaded to the inside of the image forming apparatus main body 12 at the retrieve port 100. Further the recording medium is transported with the registration roller 28 to the transfer position T at the predetermined timing. Then the recording medium is passed through a position between the image carrier 24 and the transfer device 26 four times and is ejected from the exit 20.

Note that the registration roller 90 does not have to reverse if the repeat path 92 is formed to return the recording medium in the upstream side of the registration roller 90.

Next, a third exemplary embodiment of the present invention will be described.

Figure 11:
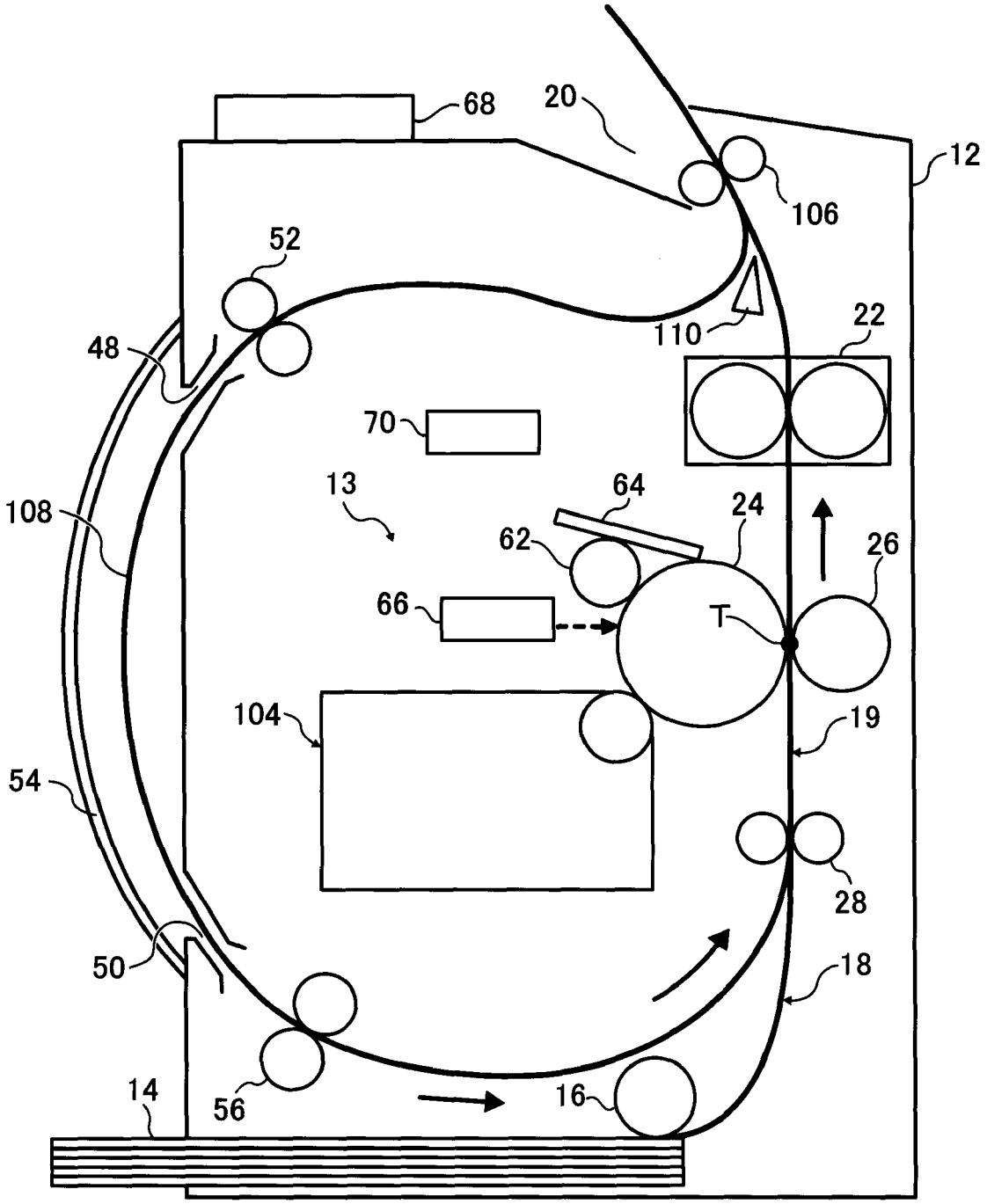
FIG. 11 is a side view showing an overview of an image forming apparatus 10*g* according to a third exemplary embodiment of the invention.

FIG. 11 is a side view showing an overview of the image forming apparatus 10*g* according to the third exemplary embodiment. Note that the image forming apparatus 10*g* shown in FIG. 11 indicates the parts substantially similar to the parts configuring the image forming apparatus 10 shown in FIG. 1 with the same reference numeral as the image forming apparatus 10.

The above-mentioned image forming apparatus 10 (Refer to FIG. 1) has the image forming part 13 with the rotary development device 57, whereas the image forming apparatus 10*g* has a developing device 104 to visualize an electrostatic latent image carried on the image carrier 24 with a black developer. Further, the above-mentioned image forming apparatus 10 has the transport path 18 with the main transport path 19 and the repeat path 46, whereas the image forming apparatus 10*g* has a transport path 18 with the main transport path 19 and a reverse path 108.

Further, in the image forming apparatus 10*g*, the exit roller 106 is capable of reversing, and the recording medium is returned to the reverse path 108 in the case of duplex printing. That is, a position of the transport path 18 short of the exit roller 106 is forked, and a switching device 110 is disposed in the forked point. Further, the reverse path 108 returning from the forked point to the registration roller 28 is formed. The switching device 110 is controlled by the controller 70.

In the case of duplex printing in the image forming apparatus 10*g* configured as mentioned above, the controller 70 controls the switching device 110 to switch a passage to the reverse path 108. Accordingly, the exit roller 106 reverses at the time where the retail edge short of the recording medium reaches the exit roller 94, and the recording medium is led to the reverse path 108. Further, the recording medium is forwarded from the forward port 48 to outside of the image forming apparatus main body 12 with the transport roller 52. Further, by guided with the guide member 54 to outside of the image forming apparatus main body 12, the recording medium is retrieved at the retrieve port 50 into the image forming apparatus main body 12, and is transported with the registration roller 28 at the predetermined timing. Furthermore, the recording medium passes through a position between the image carrier 24 and the transfer device 26 and the fixing device 22, and is ejected from the exit 20.

Next, a fourth exemplary embodiment of the present invention will be described.

Figure 12:
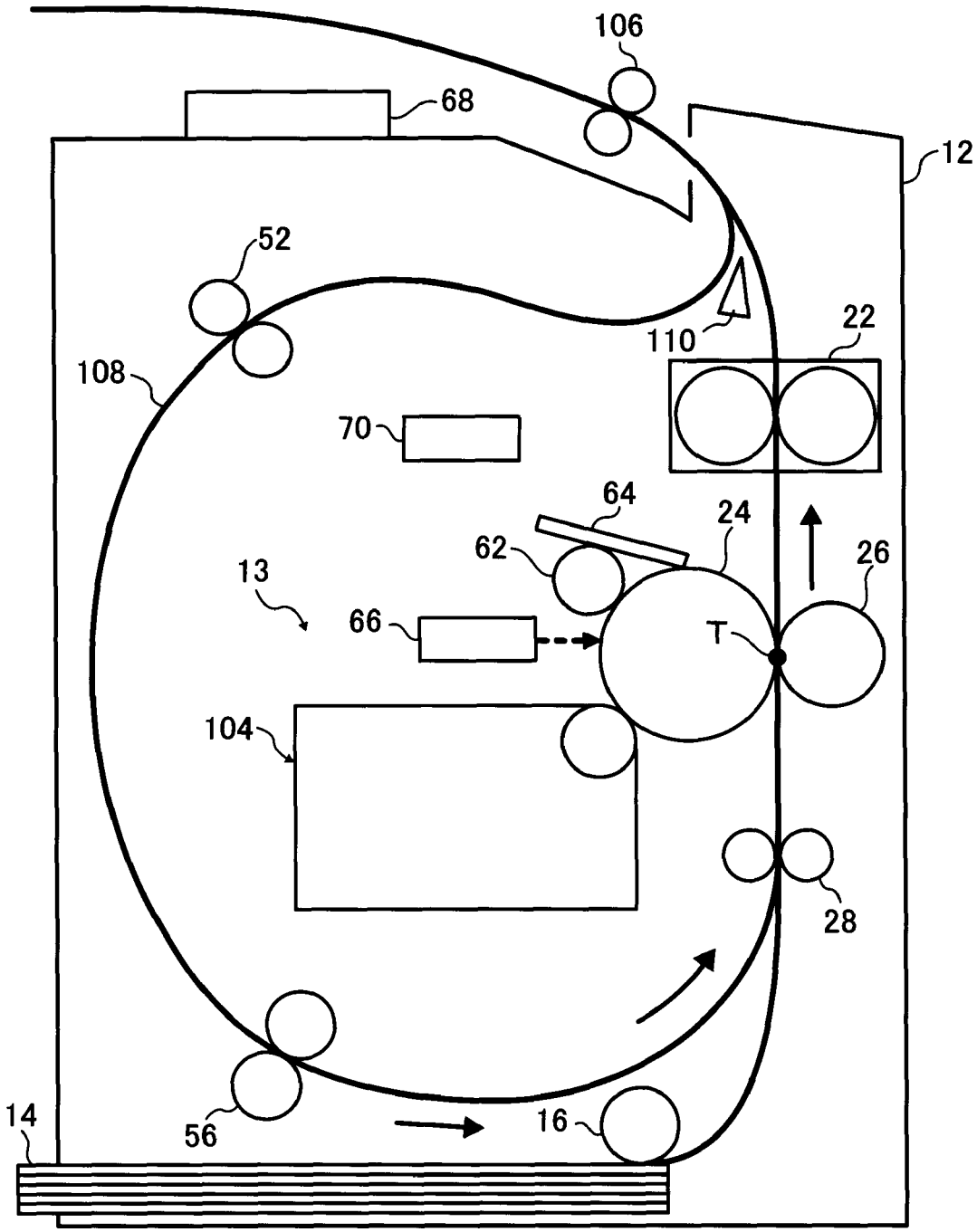
FIG. 12 is a side view showing an overview of an image forming apparatus 10*h* according to a fourth exemplary embodiment of the invention.

FIG. 12 is a side view showing an overview of the image forming apparatus 10*h* according to the fourth exemplary embodiment. Note that the image forming apparatus 10*h* shown in FIG. 12 indicates the parts substantially similar to the parts configuring the image forming apparatus 10*g* shown in FIG. 11 with the same reference numeral as the image forming apparatus 10.

The reverse path 108 in the above-mentioned image forming apparatus 10*g* has a portion which is located on outside of the image forming apparatus main body 12. Whereas, the reverse path 108 in the image forming apparatus 10*h* is located entirely inside the image forming apparatus main body 12. Further, the exit roller 106 in the image forming apparatus 10*g* is arranged inside the image forming apparatus main body 12. Whereas, the exit roller 106 in the image forming apparatus 10*h* is arranged on the outside of the image forming apparatus main body 12.

In the image forming apparatus 10*h* configured as the mentioned above, in the case of duplex printing, when the exit roller 106 catches the retail edge of the recording medium and starts rotation, it is a state that whole of the recording medium is placed on the outside of the image forming apparatus main body 12. Accordingly, even though the moisture content of the recording medium reduces by fixing the image on one surface of the recording medium, since whole of the recording medium is placed on the outside of the image forming apparatus main body 12, the moisture content of the recording medium becomes stable due to absorbing water consisted in the air on outside of the image forming apparatus main body 12. Since the image formation is performed on another surface of the recording medium in the stable moisture content state, reduction of image quality is hardly caused in forming the image on the another surface.

Next, a fifth exemplary embodiment of the present invention will be described.

Figure 13:
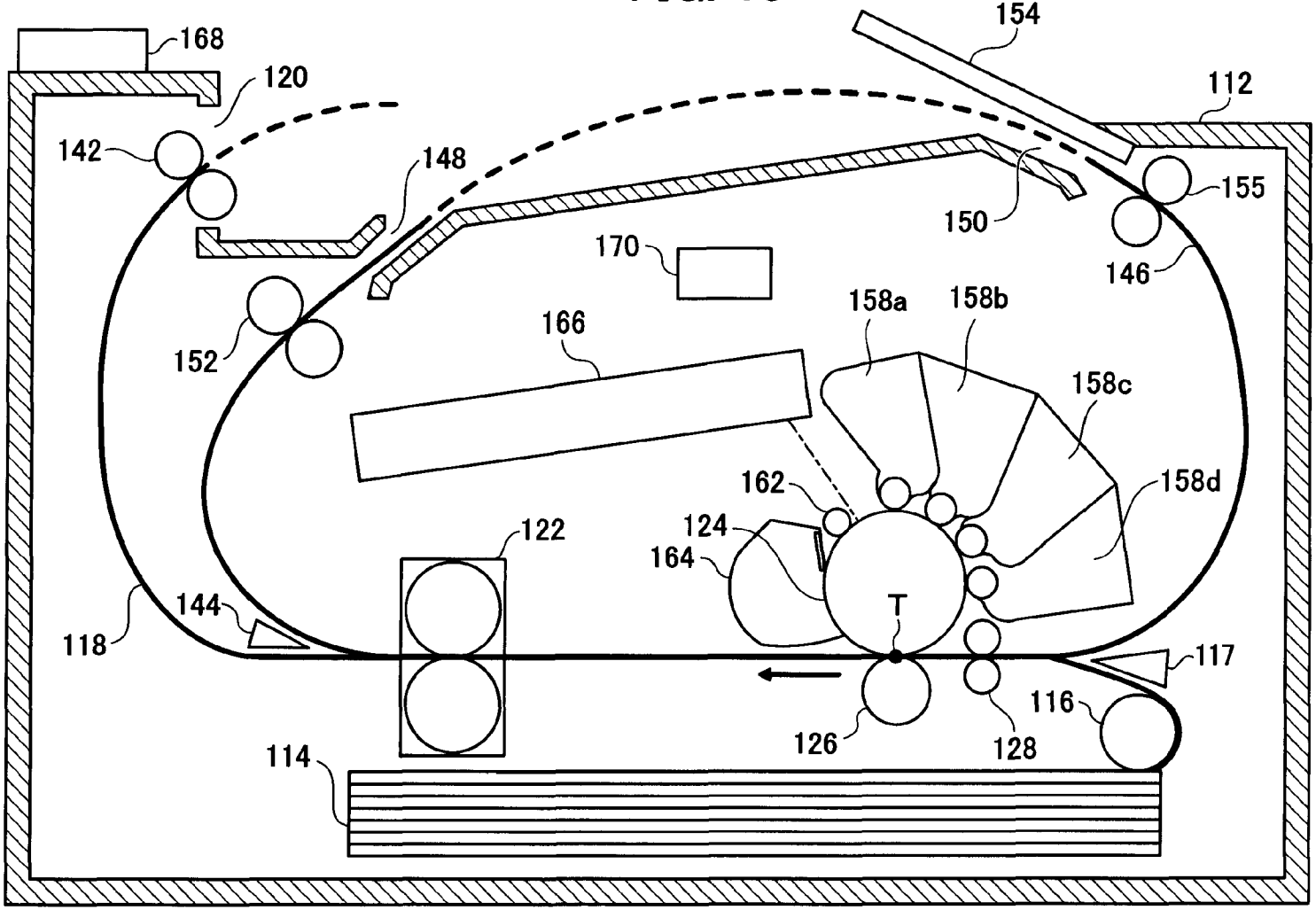
FIG. 13 is a side view showing an overview of an image forming apparatus 10*i* according to a fifth exemplary embodiment of the invention.

FIG. 13 is a side view showing an overview of the image forming apparatus 10*i* according to the fifth exemplary embodiment. As shown in FIG. 13, the image forming apparatus 10*i* has an image forming apparatus main body 112 with a sheet feed unit 114 having one stage and arranged in the bottom of the image forming apparatus main body 12.

A pickup roller 116, which picks up the recording medium such as a sheet from the sheet feed unit 114, is arranged at the upper part of the sheet feed unit 114. Driven by an unillustrated drive part, the pickup roller 116 rotates to supply the recording medium toward the transport path 118.

The transport path 118 is a recording medium passage from the pickup roller 116 to the exit 120, and guides the recording medium, picked up from the pickup roller 116, to a transfer position T to be described later with the switching device 117. The transport path 118 has a portion approximately horizontally extended in a lower part of the image forming apparatus main body 112. Along the transport path 118, the recording medium is transported to the exit 120 located at the upper part of the image forming apparatus main body 112. An image carrier 124 such as a photoreceptor and a transfer roller 126 having an elastic surface are arranged at the upstream side of the fixing device 122 on the transport path 118. Further, a registration roller 128 is arranged at the upstream side of the image carrier 124 and the transport roller 126.

Further, an exit roller 142 is arranged in proximity to the exit 120 on the transport path 118.

Accordingly, the recording medium picked up from the sheet feed unit 114 with the pickup roller 116 is led along the transport path 118, and is suspended with the registration roller 128. Further, the recording medium passes between the image carrier 124 and the transfer roller 126 at the predetermined timing with e.g. transferred a black developer image. The black developer image transferred is fixed with the fixing device 122 on the recording medium, is ejected from the exit 120 with the exit roller 142.

In the case of color printing, the recording medium is returned e.g. three times to a repeat path 146 to be described later, and a controller 170 to be described later controls an order of forming each color developer image on the image carrier 124. That is, a position of the transport path 118 in downstream of the fixing device 122 is forked, and a switching device 144 is arranged in the forked point. Further, the repeat path 146 returning the recording medium from the forked position to the registration roller 128 is formed.

The repeat path 146 has a portion formed on the top outside of the image forming apparatus main body 112, accordingly, the recording medium is forwarded to outside of the image forming apparatus main body 112 and is retrieved again inside the image forming apparatus main body 112. That is, a forward port 148 is formed in a rear side (Left side in FIG. 8), and a retrieve port 150 is formed in front side, respectively, in the upper part of the image forming apparatus main body 112. Guided with the switching device 144 to the repeat path 146, the recording medium is forward with the transport roller 152 to the outside of the image forming apparatus main body 112 from the forward port 148. Further, the recording medium is transported along the top outside of the image forming apparatus main body 112, and is retrieved into the image forming apparatus main body 112 at the retrieve port 150 by guide of the guide member 154. Thus the recording medium is transported with the transport roller 155, and is guided with the switching device 117 to the registration roller 128.

Thus, in the case of color printing, the switching device 144 switches a transport path to the repeat path 146 side. Then, the recording medium is forwarded with the transport roller 152 from the forward port 148 to the outside of the image forming apparatus main body 112, and further, is guided along the top outside of the image forming apparatus main body 112, to be retrieved into the image forming apparatus main body 12 at the retrieve port 150 by guide of the guide member 154. Further the recording medium is transported with the registration roller 128. Then the recording medium is guided with the switching device 117 to the registration roller 128 to be passed through the registration roller 128 and a position between the image carrier 124 and the transfer device 126, and the fixing device 122 four times, and is ejected from the exit 120.

Note that the guide member 154, consisting of e.g. a platy member, in the case that a color printing is not performed in the image forming apparatus 10, is capable of being stored inside the image forming apparatus main body 12.

In the image forming apparatus main body 112, development units 158*a* to 158*d* respectively containing four colors of developers, i.e., yellow, magenta, cyan, and black is disposed, e.g. in a front side of an approximately central portion. An electrostatic latent image carried on the image carrier 124 is sequentially visualized with each color developer.

In upper of the image carrier 124, a charging device 162 such as a charging roller, is provided for evenly charging the image carrier 124. Furthermore, an image carrier cleaner 164 abuts on the image carrier 124, upstream relative to the charging device 162 in the direction of rotation of the image carrier 124. The image carrier cleaner 164 scrapes away developer particles remaining on the image carrier 124 after transfer.

Above the image carrier cleaner 164, an optical projection device 166 which projects an electrostatic latent image on the image carrier 124 charged by the charging device 162, using a beam such as a laser beam is arranged. Down the image carrier 124, the above-mentioned transfer roller 126 is located. The transfer roller 126 overlay-transfers each developer image made visible with each of the development units 158*a* to 158*d* sequentially onto a recording medium in the transfer position T.

Downstream of the transfer position T, a fixing device 122 is arranged. The fixing device 122 has a heating roller and a pressure roller for fixing the developer image, which has been transferred to the recording medium with the image carrier 124 and the transfer roller 126, on the recording medium with heat and pressure and further transporting them.

Furthermore, an user interface (UI) equipment 168 such as a touch panel is disposed in a position above the image forming apparatus main body 112, and a controller 170, controlling each of part configuring the image forming apparatus 10*f* is disposed in the image forming apparatus main body 112.

Next, all operations of the image forming apparatus 10*f* in color printing will be described. When a signal to form an image is delivered, the image carrier 124 is evenly charged by the charging device 162. Toward the image carrier 124 charged, a beam corresponding to a yellow image is emitted from the optical projection device 166 based on the signal. The beam from the optical projection device 166 exposes the surface of the image carrier 124, thereby forming an electrostatic latent image.

The electrostatic latent image carried on the image carrier 124 is developed with a yellow developer supplied by the development unit 158*a*, and the developer image is transferred to the recording medium fed from the sheet feed unit 114. The recoding medium having the yellow developer image transferred thereto is led to the fixing device 122 where the heating roller and the pressure roller apply heat and pressure to the recording medium, thereby fixing the developer image onto the recording medium.

The recording medium having the yellow developer image fixed thereto is led to the repeat path 146 with the switching device 144 to be forwarded to outside of the image forming apparatus main body 112 from the forward port 148. Further, the recording medium is transported to the guide member 154 along top outside of the image forming apparatus main body 112 to be retrieved into the image forming apparatus main body 112 at the retrieve port 150, thereby is guided to the registration roller 128 with the switching device 117.

Developer particles remaining on the image carrier 124 is scraped off with the image carrier cleaner 164.

Furthermore, the image carrier 124 is evenly charged again with the charging device 162. Toward the image carrier 124 charged, a beam corresponding to a magenta image is emitted from the optical projection device 166 based on the image signal. The beam from the optical projection device 166 exposes the surface of the image carrier 124, thereby forming an electrostatic latent image.

The electrostatic latent image carried on the image carrier 124 is developed with a magenta developer in the development unit 158*b*. The magenta developer image is overlay-transferred to the recording medium having passed through the repeat path 146.

The recording medium having the magenta developer image transferred thereto is led to the fixing device 122 where the heating roller and the pressure roller applies heat and pressure to the recording medium, thereby fixing the developer image onto the recording medium. Then, the recording medium having the magenta developer image fixed thereon is guided to the repeat path 146 with the switching device 144. Developer particles remaining on the image carrier 124 are scraped off with the image carrier cleaner 164.

The recording medium is returned to the registration roller 128 three times, and as in the case of the yellow and magenta developer images, developer images developed with the cyan and the black developers are fixed on the recording medium. Thus a color image is formed with overlaid developer images on the recording medium. The recording medium to which the color image has been fixed is led to the exit roller 142 with the switching device 144 and is ejected.

Further, in the exemplary embodiment mentioned above, the description has been provided for an example in which an image is formed by an image forming unit including the image carrier 24, the charging device 62, the optical projection device 66, the rotary development device 57, the transfer device 57, the transfer device 26, and the fixing device 22. However, the scope of the present invention is not so limited. The image forming unit may be e.g. an ink jet type.

In the image forming apparatus 10*i*, the image carrier 124, the charging device 162, the optical projection device 166, the development units 158*a*, 158*b*, 158*c*, and 158*d*, and the transfer roller 126 are disposed in the image forming apparatus main body 112, and are used as a image forming unit forming an image on the recording medium as mentioned above. Further, in the image forming apparatus 10*i*, as a transport unit transporting the recording medium to the image forming unit including the development unit 158*a*, and the like, the transport path 118, the repeat path 146, the transport rollers 152 and 155 are used. Furthermore, in the image forming apparatus main body 11, the forward port 148 at which the recording medium formed the image formed by the image forming unit onto, is forwarded to outside of the image forming apparatus main body 112 is formed. Further, in the image forming apparatus 10*i*, the guide member 154, by which the recording medium, forwarded to outside of the image forming apparatus main body 112 from the forward port 148 is guided to be returned into the image forming apparatus main body 112 and to be led to the above-mentioned transport unit, is formed.

In the image forming apparatus 10*i*, the image carrier 124, the charging device 162, the optical projection device 66, and the development units 158*a*, 158*b*, 158*c*, and 158*d* are disposed in the image forming apparatus main body 112 and are used as the image forming part forming an image. The image formed by the image forming part is transferred to the recording medium with the transfer roller 126, and is fixed on the recording medium by at least heating with the fixing device 122. Further, in the image forming apparatus 10*i*, the repeat path 146, the transport rollers 152 and 155 are used as the transport unit which transports the recording medium from the fixing device 122 to the transfer roller 126 so as to further transfer an image on the recording medium fixed the image onto with the fixing device 122. In the transport unit, the recording medium fixed the image onto with the fixing device 122 is forwarded again to outside of the image forming apparatus main body 112, and is retrieved into the image forming apparatus main body 112.

As described above, the exemplary embodiment of the present invention is applicable to an image forming apparatus of e.g. a duplicate machine, a printer, a facsimile machine, or the like.

The foregoing description of the exemplary embodiments of the present invention has been provided for the purposes of illustration and description. It is not intended to be exhaustive or to limit the invention to the precise forms disclosed. Obviously, many modification and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming apparatus main body, an image forming part provided in the image forming apparatus main body and forming an image, a transfer device transferring the image formed by the image forming part on a recording medium, a fixing device fixing the image transferred with the transfer device on the recording medium with at least heat, and a transport unit transporting the recording medium from the fixing device to the transfer device so as to transfer further an image on the recording medium having the fixed image, wherein the image forming apparatus main body has a forward port for forwarding the recording medium having the fixed image thereon by the fixing device to outside of the image forming apparatus main body, and further has a guide unit by which the recording medium forwarded to the outside of the image forming apparatus main body is guided to be retrieved into the image forming apparatus main body, and to be led to the transport unit, the transport unit forwards the recording medium to the fixing device to fix the later transferred image, then transports the medium toward outside of the image forming apparatus main body, and retrieves again the recording medium into the image forming apparatus main body, the image forming part is capable of forming a plurality of color images one by one, and the image forming apparatus further has an image forming control unit by which the recording medium having the fixed image thereon is controlled to be forwarded to the outside of the image forming apparatus main body whenever a single-color image formed by the image forming part is transferred onto the recording medium with the transfer device, and the single-color image transferred with the transfer device is fixed on the recording medium with the fixing device.

2. The image forming apparatus according to claim 1, wherein the image forming unit forms the plurality of color images onto the recording medium one by one, and the image forming control unit controls the recording medium having the image thereon to be forwarded from the forward port to the outside of the image forming apparatus main body whenever a single color image is formed on the recording medium by the image forming unit.

3. The image forming apparatus according to claim 1, further comprising a reversing guide unit that guides the recording medium to the transport unit while reversing the recording medium.

4. The image forming apparatus according to claim 1, wherein the transport unit transports the recording medium having the image thereon for forwarding from the forward port to the outside of the image forming apparatus main body with the recording medium rotated around at least a portion of the image forming unit, and retrieving the recording medium into the image forming apparatus main body.

5. The image forming apparatus according to claim 1, wherein the guide unit is capable of being stored in the image forming apparatus main body.

6. The image forming apparatus according to claim 1, wherein the guide unit has a retrieve guide part by which the recording medium is guided to be retrieved from the outside of the image forming apparatus main body to the inside thereof, at least at a retrieve position where the recording medium is retrieved into the image forming apparatus main body.

7. The image forming apparatus according to claim 1, further comprising:

a recording medium length acquisition unit that obtains a recording medium length in the transporting direction of the recording medium transported by the transport unit; and a forward control unit that switches a forward direction of the recording medium forwarded from the forward port or a forward position of the recording medium forwarded via the forward port, based on the recording medium length obtained by the recording medium length acquisition unit.

8. An image forming apparatus, comprising:

an image forming apparatus main body, an image forming part provided in the image forming apparatus main body and forming an image, the image forming part being capable of forming a plurality of color images one by one a transfer device transferring the image formed by the image forming part on a recording medium, a fixing device fixing the image transferred with the transfer device on the recording medium with at least heat, an image forming control unit by which the recording medium having the fixed image thereon is controlled to be forwarded to the outside of the image forming apparatus main body whenever a single-color image formed by the image forming part is transferred onto the recording medium with the transfer device, and the single-color image transferred with the transfer device is fixed on the recording medium with the fixing device, and a transport unit transporting the recording medium from the fixing device to the transfer device so as to transfer further an image on the recording medium having the fixed image, wherein the transport unit forwards the recording medium to the fixing device to fix the later transferred image, then transports the medium toward outside of the image forming apparatus main body, and retrieves again the recording medium into the image forming apparatus main body.

9. The image forming apparatus according to claim 8, further comprising a forward time control unit that controls the time where the recording medium, which is forwarded to the outside of the image forming apparatus main body, is retrieved into the image forming apparatus main body on the basis of at least one of the recording medium type, thickness of the recording medium, heating temperature of the recording medium in the fixing device, and heating time of the recording medium in the fixing device.

* * * * *